US012370458B2

(12) United States Patent
Schuyler et al.

(10) Patent No.: US 12,370,458 B2
(45) Date of Patent: Jul. 29, 2025

(54) TOY ASSEMBLY WITH ENCLOSURE WITH OPTIONAL FLAPS AND INNER OBJECT

(71) Applicants: DiscoNifty Ltd., Toronto (CA); Spin Master Ltd., Toronto (CA)

(72) Inventors: Robert Schuyler, Toronto (CA); Kristin Aydin, New York, NY (US)

(73) Assignees: SPIN MASTER LTD., Toronto (CA); DISCONIFTY LTD., Toronto (CA)

( * ) Notice: Subject to any disclaimer, the term of this patent is extended or adjusted under 35 U.S.C. 154(b) by 759 days.

(21) Appl. No.: 17/539,972

(22) Filed: Dec. 1, 2021

(65) Prior Publication Data

US 2022/0258064 A1 Aug. 18, 2022

Related U.S. Application Data

(60) Provisional application No. 63/149,662, filed on Feb. 15, 2021.

(51) Int. Cl.
*A63H 3/52* (2022.01)
*A63H 3/28* (2006.01)

(52) U.S. Cl.
CPC ..... *A63H 3/52* (2013.01); *A63H 3/28* (2013.01); *A63H 2200/00* (2013.01)

(58) Field of Classification Search
CPC ..... A63H 3/28; A63H 3/52; A63H 13/18
USPC ..... 446/297, 308, 309, 310, 311, 330, 371
See application file for complete search history.

(56) References Cited

U.S. PATENT DOCUMENTS 1,202,301 A * 10/1916 MacKaye ..... A63H 13/16 446/310
3,471,964 A * 10/1969 Cherry ..... A63H 33/00 446/268
3,597,877 A * 8/1971 Speers ..... A63H 33/00 446/72
4,736,943 A * 4/1988 Fukuda ..... A63H 33/00 472/54
4,817,936 A * 4/1989 Matsuda ..... A63H 33/005 446/355
5,090,569 A * 2/1992 Nissen ..... G09F 19/08 446/486
5,213,538 A * 5/1993 Willett ..... A63H 3/003 473/569
5,310,378 A * 5/1994 Shannon ..... A63H 33/004 446/72

(Continued)

*Primary Examiner* — Joseph B Baldori
(74) *Attorney, Agent, or Firm* — Aird & McBurney LP

(57) ABSTRACT

An aspect provides a toy assembly comprising: a toy character; an enclosure including an enclosure biasing structure and positionable in a closed position to at least partially enclose the toy character; and a latch assembly including: a latching member; and a deformable member that deforms upon application of an electric current. The enclosure biasing structure is positioned to urge the enclosure towards an open position to expose the toy character. The latching member is movable between (i) a latched position in which the latching member is releasably engaged with a connecting member to hold the enclosure in the closed position, and (ii) an unlatched position in which the latching member is disengaged from the connecting member to permit the enclosure biasing structure to drive the enclosure towards the open position. Deformation of the deformable member causes the latching member to move from the latched position to the unlatched position.

17 Claims, 15 Drawing Sheets

(56) References Cited

U.S. PATENT DOCUMENTS

| | | | | | |
|---|---|---|---|---|---|
| 5,522,758 | A * | 6/1996 | Liu | A63H 13/00 | 40/411 |
| 5,989,092 | A * | 11/1999 | McGowan | A63H 33/003 | 446/175 |
| 6,389,718 | B1 * | 5/2002 | Joo | A41G 1/002 | 40/412 |
| 6,468,126 | B1 * | 10/2002 | Herber | A63H 37/00 | 472/51 |
| 6,719,606 | B1 * | 4/2004 | Mukensturm | A63H 3/005 | 446/72 |
| 6,796,872 | B2 * | 9/2004 | Herber | A63H 37/00 | 446/486 |
| 7,861,444 | B2 * | 1/2011 | Marlow | A41G 1/002 | 40/411 |
| 8,127,952 | B2 * | 3/2012 | Grubba | A63H 19/18 | 213/75 TC |
| 8,133,090 | B2 * | 3/2012 | Hardin | A63H 3/50 | 446/268 |
| 8,628,372 | B2 * | 1/2014 | Cabrera | F03G 7/065 | 60/527 |
| 8,636,518 | B2 * | 1/2014 | Wetherbee | G09B 19/00 | 434/238 |
| 9,868,073 | B2 * | 1/2018 | Yamada | A63H 3/003 | |
| 10,362,821 | B2 * | 7/2019 | Lee | F16M 11/041 | |
| 10,864,452 | B2 * | 12/2020 | Fernandez | A63H 13/00 | |
| 11,123,653 | B2 * | 9/2021 | Choi | A63H 33/26 | |
| 12,011,675 | B1 * | 6/2024 | Schuyler | A63H 33/003 | |
| 2007/0197124 | A1 * | 8/2007 | Sato | A63H 3/003 | 446/129 |
| 2018/0311593 | A1 * | 11/2018 | Choi | A63H 33/003 | |

* cited by examiner

TOY ASSEMBLY WITH ENCLOSURE WITH OPTIONAL FLAPS AND INNER OBJECT

CROSS-REFERENCE TO RELATED APPLICATIONS

This application claims the benefit of U.S. Provisional Patent Application No. 63/149,662, filed Feb. 15, 2021, the contents of which are incorporated herein by reference in their entirety.

FIELD

This disclosure relates generally to toy assemblies, and more particularly to toy assemblies comprising remotely driven latch assemblies movable between a latched position and unlatched position upon the application of an electric current.

BACKGROUND OF THE DISCLOSURE

Toy assemblies may employ latches to releasably attach one toy component, such as an article of toy clothing, to another toy component, such as the body of a toy character. Repeated latching and unlatching of the components may eventually lead to failure of the latching/unlatching mechanism of action. Further, manual separation of the latched components by a user is often required, and toy assemblies are often unable to detect whether they are in a latched or unlatched state. Where more complex latch assemblies are employed, the latching assembly may introduce bulk to the toy assemblies in undesirable areas.

SUMMARY OF THE DISCLOSURE

In an aspect there is provided a toy assembly comprising: a toy character; an enclosure including an enclosure biasing structure; and a latch assembly. The enclosure is positionable in a closed position to at least partially enclose the toy character. The enclosure biasing structure is positioned to urge the enclosure towards an open position to expose the toy character. The latch assembly includes: a latching member, and a deformable member that deforms upon application of an electric current. The latching member is movable between (i) a latched position in which the latching member is releasably engaged with a connecting member to hold the enclosure in the closed position, and (ii) an unlatched position in which the latching member is disengaged from the connecting member to permit the enclosure biasing structure to drive the enclosure towards the open position. The deformable member is operatively engaged with the latching member such that deformation of the deformable member upon the application of the electric current thereto causes the latching member to move from the latched position to the unlatched position.

Other technical advantages may become readily apparent to one of ordinary skill in the art after review of the following figures and description.

BRIEF DESCRIPTIONS OF THE DRAWINGS

For a better understanding of the various embodiments described herein and to show more clearly how they may be carried into effect, reference will now be made, by way of example only, to the accompanying drawings in which.

Figures 1A, 1B:
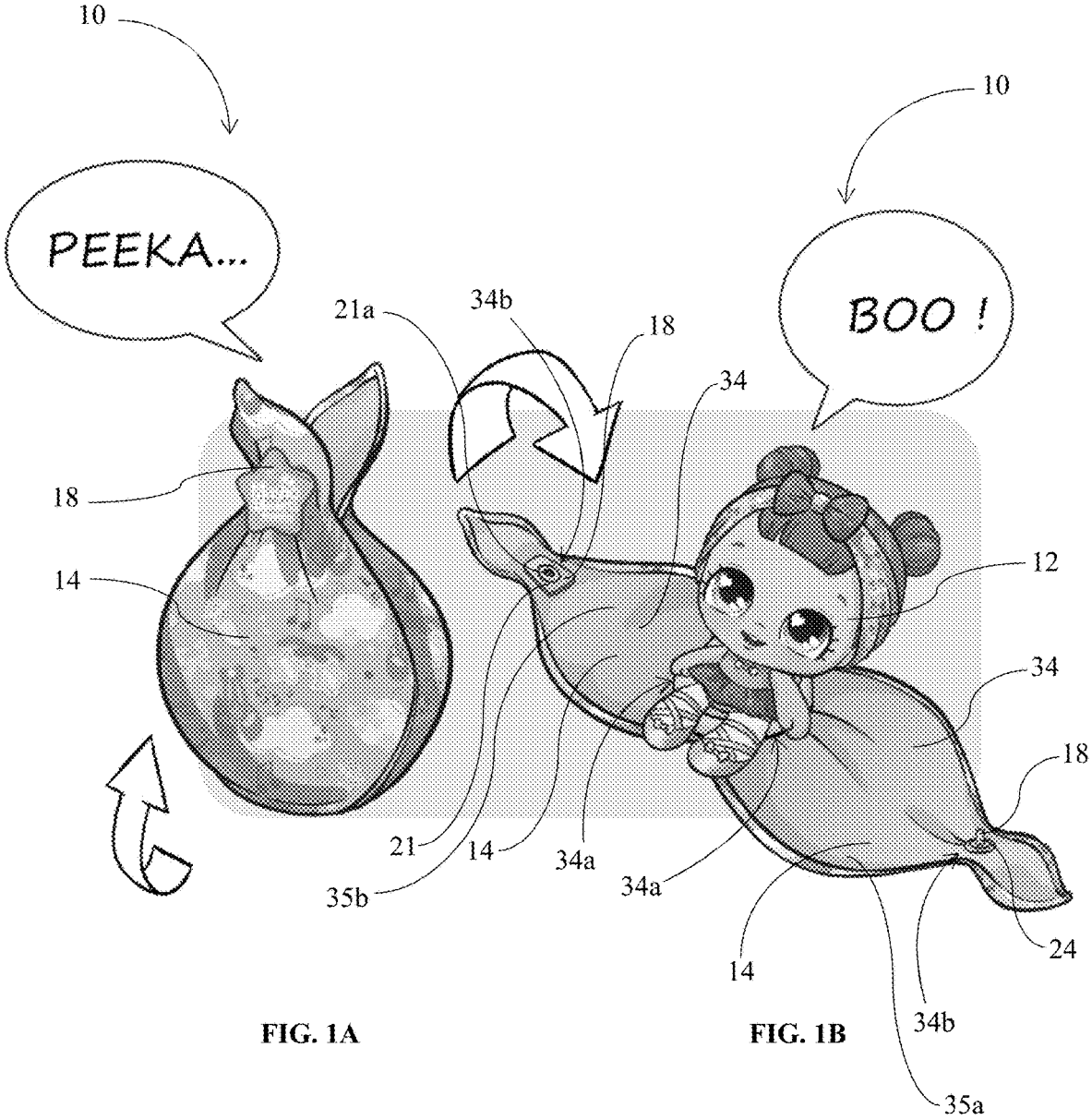
FIG. 1A depicts a front perspective view of an example toy assembly in an enclosed configuration.
FIG. 1B depicts a front perspective view of an example toy assembly in an open configuration.

Unless otherwise specifically noted, articles depicted in the drawings are not necessarily drawn to scale.

DETAILED DESCRIPTION

For simplicity and clarity of illustration, where considered appropriate, reference numerals may be repeated among the figures to indicate corresponding or analogous elements. In addition, numerous specific details are set forth in order to provide a thorough understanding of the embodiment or embodiments described herein. However, it will be understood by those of ordinary skill in the art that the embodiments described herein may be practiced without these specific details. In other instances, well-known methods, procedures and components have not been described in detail so as not to obscure the embodiments described herein. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

The indefinite article "a" is intended to not be limited to meaning "one".

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Directional terms used herein, such as "front", "forward", "back", "rear", "rearward", "side", "right", "left", "top", "bottom", "under", "atop", "below", "over", and other related or like terms are used to convey relative positions of the described components with respect to one another and are otherwise not intended to limit the described embodiments.

Well-known methods, procedures and components have not been described herein in detail so as not to obscure the example embodiments described herein. Also, persons of skill in the art will appreciate that there are alternative implementations and modifications, beyond those of the example embodiments described herein, that are possible, and that the described embodiments are only for illustration of one or more example implementations. The description, therefore, is not to be considered as limiting scope, which is only limited by the claims appended hereto.

With reference to the figures, a toy assembly 10 may comprise a toy character 12, and an enclosure 14. In some aspects, the enclosure 14 may include an enclosure biasing structure 16, and the enclosure 14 may be positionable in a closed position (shown, e.g., in FIG. 1A) to at least partially enclose the toy character 12. In some aspects, the enclosure biasing structure 16 may be positioned to urge the enclosure 14 towards an open position (shown, e.g., in FIG. 1B, in which example the enclosure biasing structure 16 is positioned substantially within flaps 34, discussed further below) to expose the toy character 12.

The toy assembly 10 may further comprise a latch assembly 18 which, in some aspects, may include at least a latching member 20 (which may be housed in a latching member housing 21), a driver assembly 22, and a connecting member 24. The latching member housing 21 may include a receptable or opening 21*a* for receipt of the connecting member 24 therein, for latching of the connecting member 24 to the latching member 20 (see, e.g., FIG. 1B (showing the connecting member 24 disengaged from the latching member 20 and therefore separated from the receptacle 21*a*) and FIG. 1A (in which the connecting member 24 has been received within the receptacle 21*a* where it is releasably engaged with the latching member 20 to hold the enclosure 14 in the closed position, as described further, below)). The latch assembly 18 may further include a deformable member 26 that deforms upon application of an electric current thereto. For example, the latching member 20 may be movable between (i) a latched position (shown, e.g., in FIGS. 4A and 4B) in which the latching member 20 is releasably engaged with the connecting member 24 to hold the enclosure 14 in the closed position, and (ii) an unlatched position (shown, e.g., in FIGS. 5A and 5B) in which the latching member 20 is disengaged from the connecting member 24 to permit the enclosure biasing structure 16 to drive the enclosure 14 towards the open position (FIGS. 5A and 5B depicting the latching member 20 disengaged from the connecting member 24 prior to the enclosure biasing structure 16 (and/or the connecting member biasing structure 44 (described further below and shown, e.g., in FIG. 5B), which may comprise the, or a part of the, enclosure biasing structure 16) driving the enclosure 14 towards the open position).

Figure 3B:
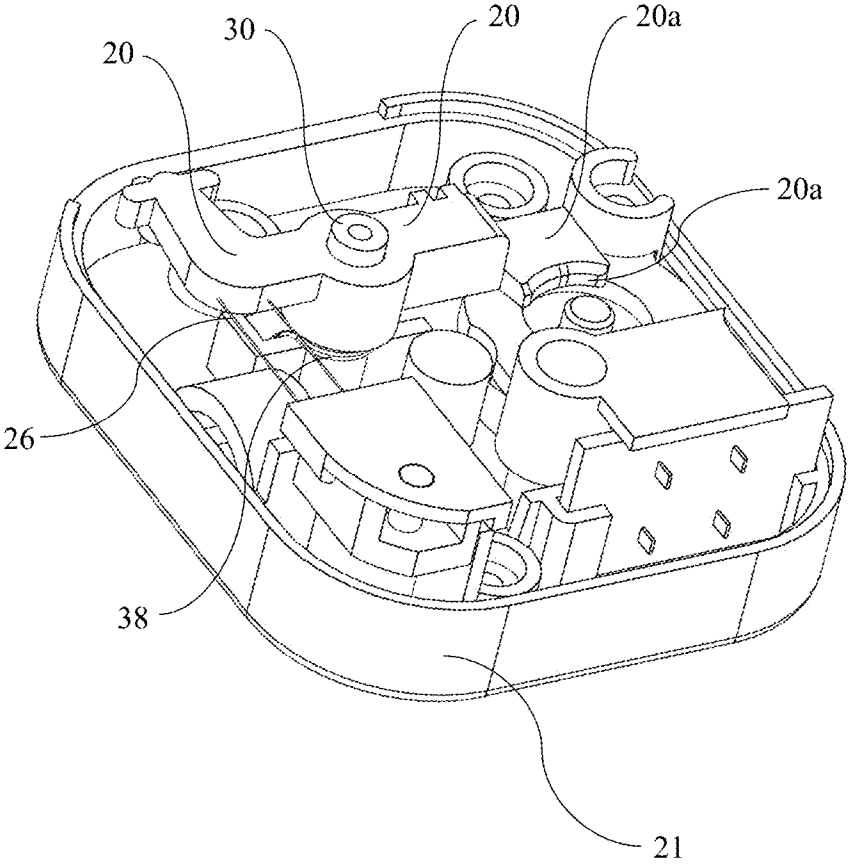
FIG. 3B depicts another perspective view of the bottom portion of an example interior of an example latching member housing.
Figure 3A:
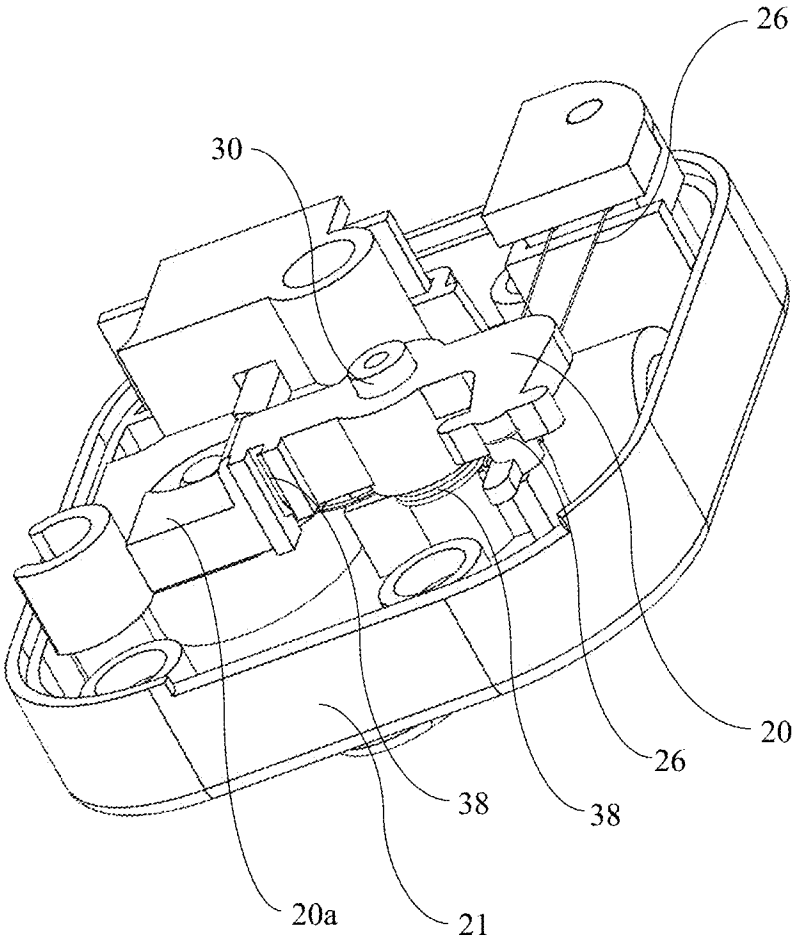
FIG. 3A depicts a perspective view of a bottom portion of an example interior of an example latching member housing.
Figure 4A:
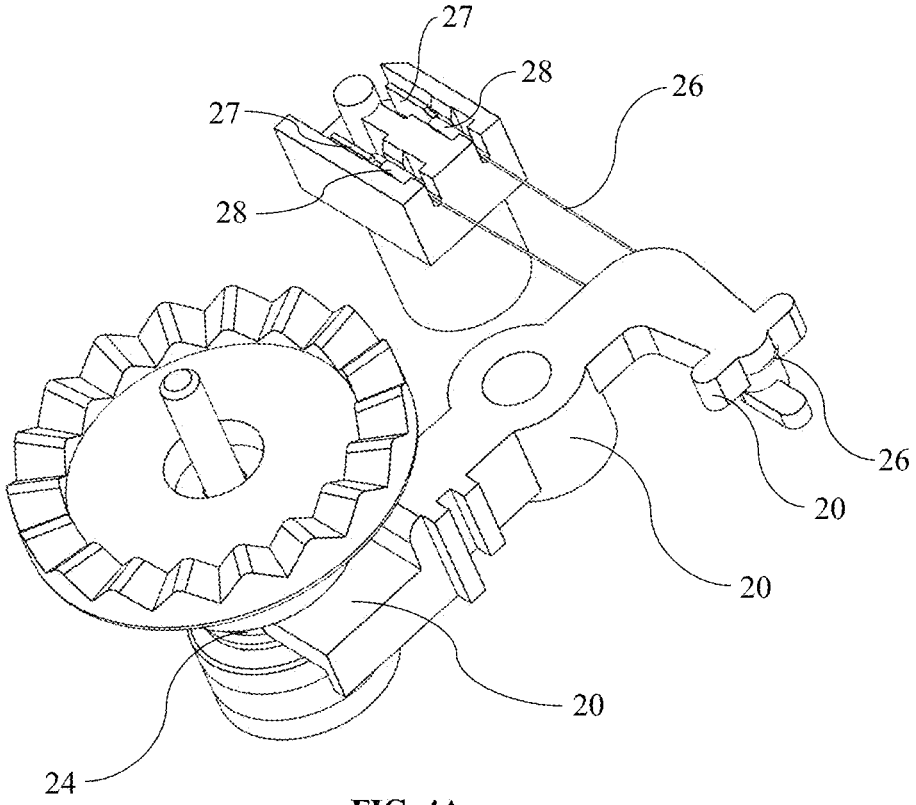
FIG. 4A depicts a perspective view of an example deformable member operatively engaged with an example latching member, and the example latching member releasably engaged with an example connecting member.
Figure 4B:
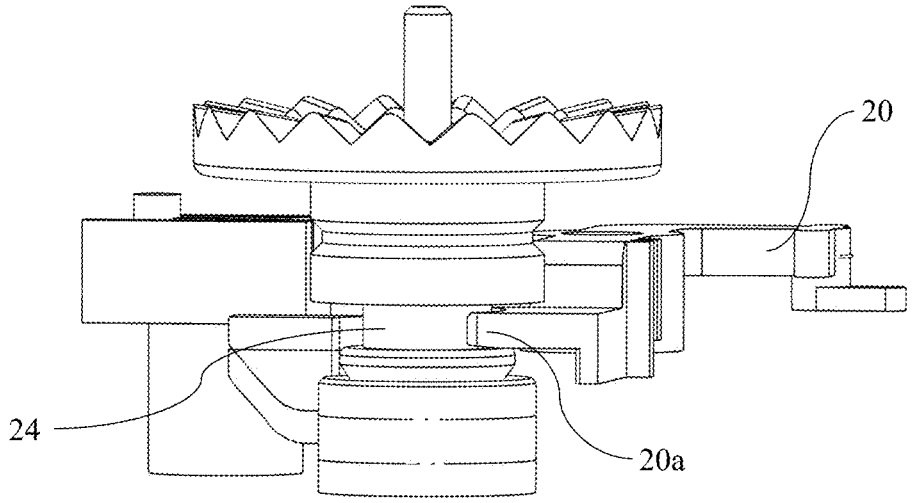
FIG. 4B depicts another perspective view of the example deformable member, latching member and connecting member shown in FIG. 4A.
Figure 5A:
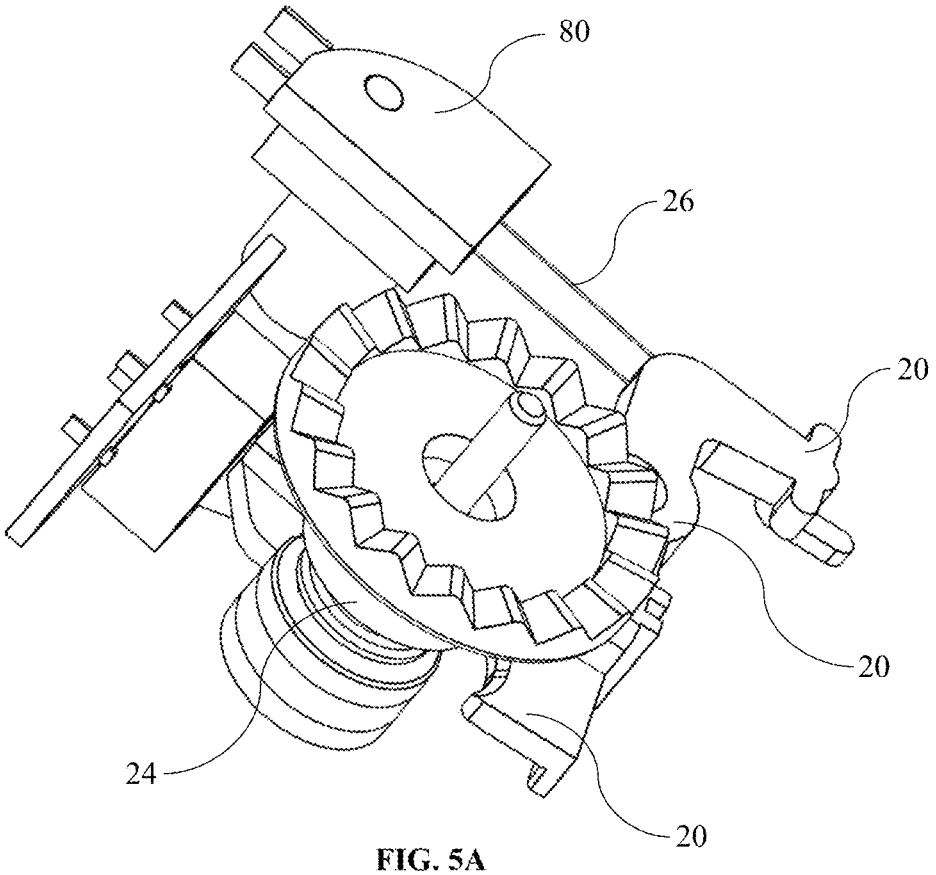
FIG. 5A depicts a perspective view of an example deformable member, in a contracted state, operatively engaged with an example latching member, and the example latching member disengaged from an example connecting member.
Figure 5B:
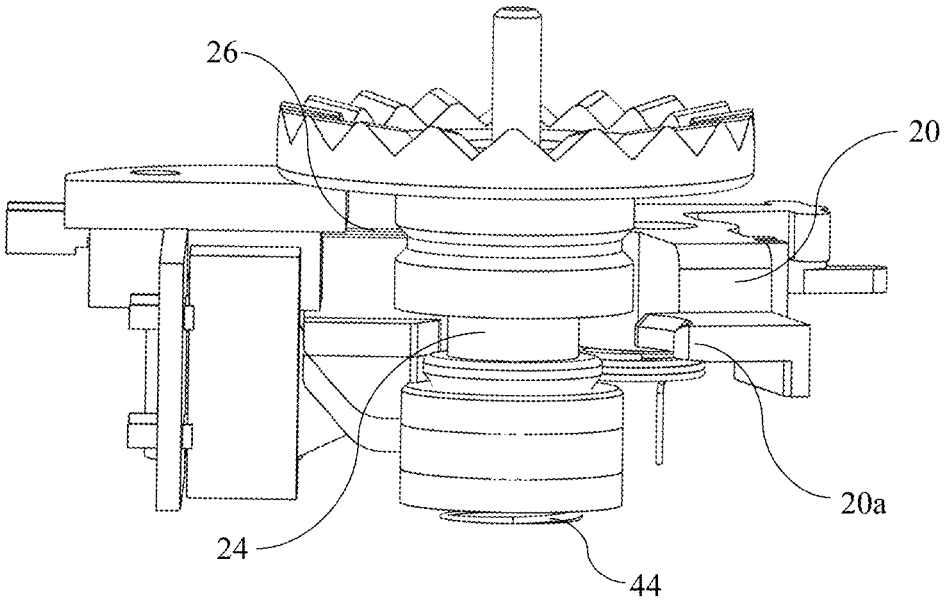
FIG. 5B depicts another perspective view of the example deformable member, latching member and connecting member shown in FIG. 5A.

The deformable member 26 may be operatively engaged with the latching member 20 such that deformation of the deformable member 26 upon the application of the electric current thereto causes the latching member 20 to move from the latched position (shown, e.g., in FIGS. 4A and 4B) to the unlatched position (shown, e.g., in FIGS. 5A and 5B). Such operative engagement between the deformable member 26 and the latching member 20 may, in some aspects, be as shown in the figures; for example, the deformable member 26 may be looped around the latching member 20, such as shown in FIG. 4A, so that when the deformable member 26 deforms, upon the application of an electric current thereto, the deformable member 26 may, e.g., contract or shrink so as to pull the latching member 20 which, being pivotally engaged with a pivot member 30 at an intermediate portion of the latching member 20 (see, e.g., FIGS. 3A and 3B), may cause a latching portion 20*a* of the latching member 20 (see, e.g., FIGS. 3A, 3B, 4A and 4B) to move out of engagement with (or disengage from) the connecting member 24 (as shown, e.g., in FIGS. 5A and 5B). The pivot member 30 may be attached to, or comprise a portion of, the housing 21. Such looping of the deformable member 26 around the latching member 20 is expected to mitigate against reduced effectiveness or failure, over time, of the latching and unlatching mechanism of action (i.e., the deformation of the deformable member 26 to transition the latching member 20 between the latched and unlatched positions). For example, the looping of the deformable member 26 around the latching member 20 may yield an operative engagement between the deformable member 26 and the latching member 20 that may be less susceptible to failure (such as by disconnection) after repeated use.

It will be appreciated that the deformable member 26 may be operatively engaged with the latching member 20 in ways other than that shown in the figures, provided that its deformation would transition a latching member 20 (which may also be configured and/or cooperatively engaged with the housing 21 other than as shown in the figures) between the latched and unlatched positions. For example, in some aspects, the deformable member 26 may be attached to the latching member 20 by screw(s) which screw into the latching member 20 to hold the deformable member 26 against the latching member 20 by screw heads thereof. Furthermore, the latching member 20 may be configured so that expansion of the deformable member 26, or some deformation of the deformable member 26 other than shrinkage or contraction (such as curving or bending, for example), causes the latching member 20 to move from the latched position to the unlatched position. The deformable member 26 may include, e.g., a wire 26 made from a shape memory alloy and, as described above, the deformable member 26 (such as a shape memory alloy wire 26) may contract upon the application of the electric current thereto.

In some aspects, the electric current may be conducted to the deformable member 26, e.g., by metal leads 27 attached to one or more ends of the deformable member 26 and to which the electrical conduit 42 may connect, as shown in FIGS. 4A and 4B, which may be attached leads 27 may be attached to the deformable member 26 and/or the electrical conduit 42 by welded connection(s), or by couplers 28 maintaining electrical conduction between the leads 27 and the deformable member 26 and/or the electrical conduit 42, for example. As shown, e.g., in FIG. 5A, such connecting components (such as the connections between the electrical conduit 42, the deformable member 26, the leads 27, and/or the couplers 28) may be covered by a covering 80. Yet other suitable manners of conducting the electric current from the electrical conduit 42 to the deformable member 26 may be used, so as to cause the deformation of the deformable member 26 upon the application of electric current thereto.

In some aspects, the enclosure 14 may include a base 32 (see, e.g., FIG. 2) and a plurality of flaps 34 (see, e.g., FIG. 1B). Each flap 34 may have a proximal end 34*a* connected to the base 32, and a distal end 34*b*, generally opposite the proximal end 34*a*. The plurality of flaps 34 may be positionable in a spread-open position (shown, e.g., in FIG. 1B) in which the plurality of flaps 34 are spread apart from one another (and which corresponds to the open position for the enclosure 14), and a mutually engaged position (shown, e.g., in FIG. 1A) in which the distal ends 34*b* of the plurality of flaps 34 are mutually engaged with one another (and which corresponds to the closed position for the enclosure 14).

Figure 2:
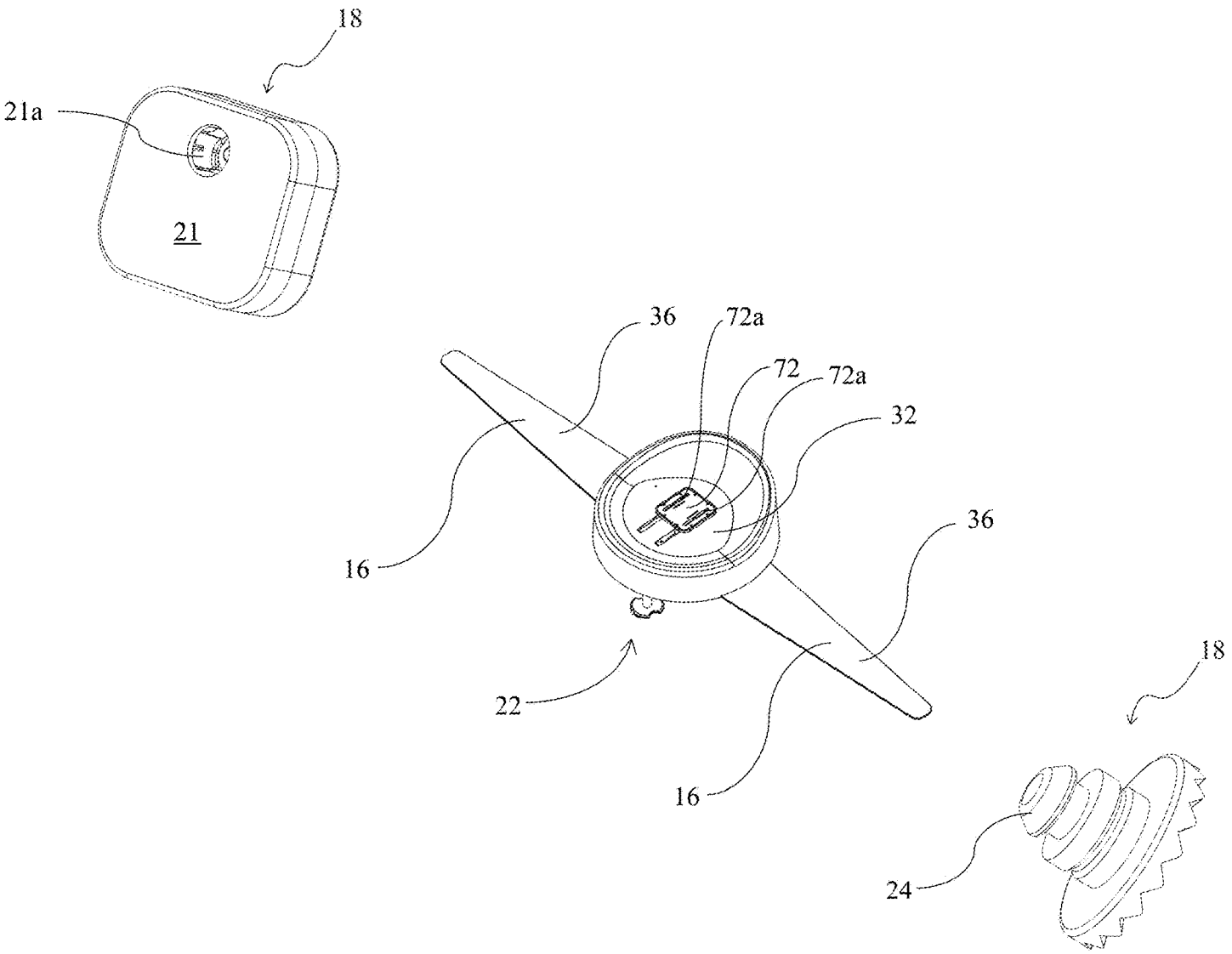
FIG. 2 depicts perspective views of an example latching member housing, driver assembly, base, toy character receiving structure, enclosure biasing structure, and connecting member.

In some aspects, the enclosure biasing structure 16 may comprise a plurality of flap biasing members 36 (see, e.g., FIG. 2). Each of the flap biasing members 36 may be operatively engaged with a respective one of the flaps 34, to urge the respective flap 34 to the spread-open position shown in FIG. 1B, for example. As shown, e.g., in FIGS. 4A and 4B, the latching member 20, when in the latched position, may cooperate with the connecting member 24 to hold the plurality of flaps 34 in the mutually engaged position (shown, e.g., in FIG. 1A). For example, each of the flaps 34 may comprise a fabric covering 34 (e.g., resembling a toy blanket, as shown in the example aspects depicted in the figures). The flaps may substantially cover or enclose respective flap biasing members 36 so as to effect the operative engagement between the flap biasing members 36 and the flaps 34. In other aspects, the flaps 34 may be operatively engaged with the flap biasing members 36 in other ways, provided that the enclosure biasing structure 16 (such as the flap biasing members 36) may drive the enclosure 14 (such as the flaps 34 thereof) towards the open position of the enclosure 14 (corresponding to the spread-open position of the flaps 34) when the latching member 20 is disengaged from the connecting member 24, as shown in FIG. 1B.

Figure 6:
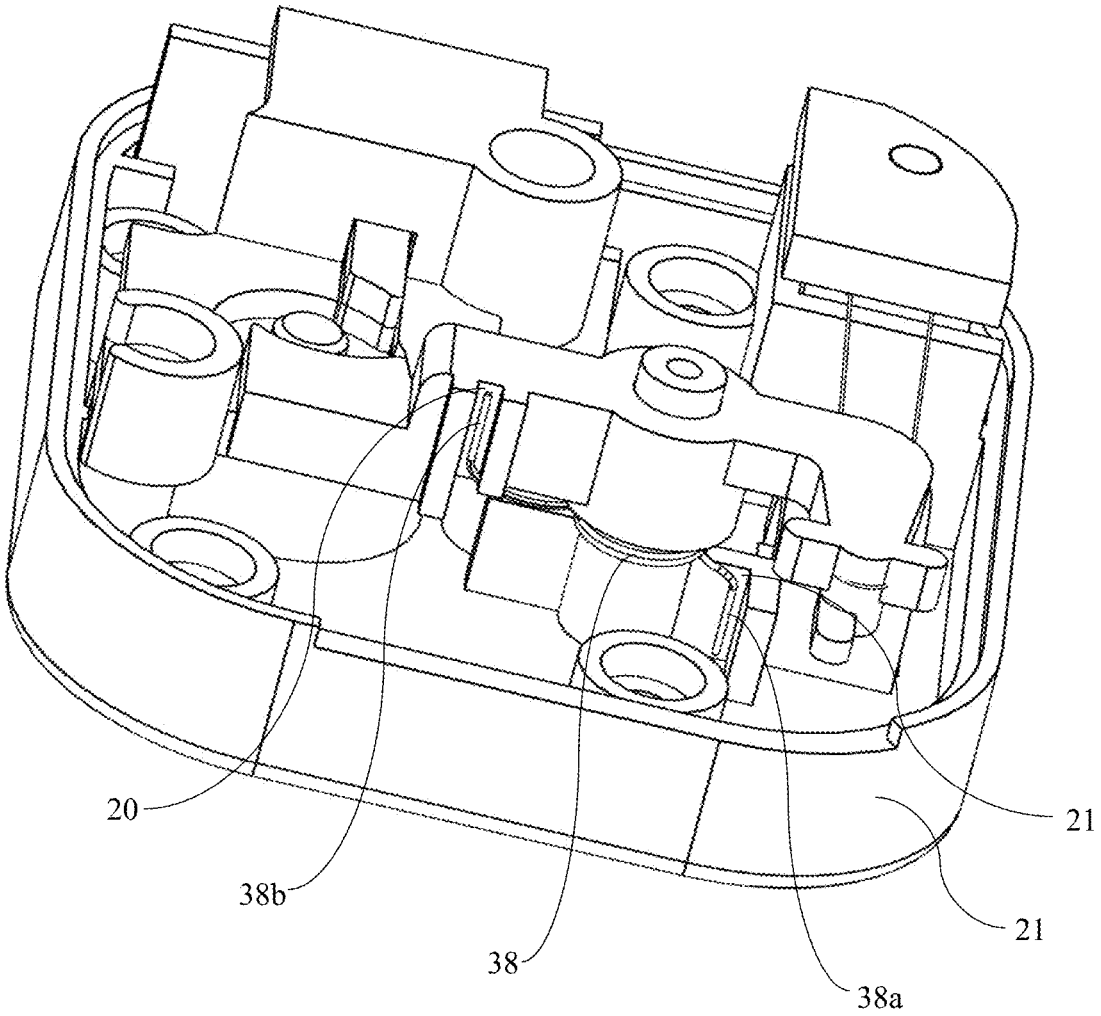
FIG. 6 depicts another partial perspective view of a bottom portion of an example interior of an example latching member housing.

In some aspects, the latch assembly 18 may further include a latching member biasing structure 38 (see, e.g., FIGS. 3 and 6) that applies a latching member biasing structure force to urge the latching member 20 toward the latched position (shown, e.g., in FIGS. 4A and 4B). To effect the transition of the latching member 20 to the unlatched position (shown, e.g., in FIGS. 5A and 5B) by application of the electric current to the deformable member 26, a force of the deformable member 26 during deformation thereof by application of the electric current thereto may be greater than the force of the latching member biasing structure 38. In some aspects, and as more clearly shown in FIG. 6, the latching member biasing structure 38 may include a torsion spring 38 (which may be positioned on or about, e.g., the pivot member 30), with a housing engaging portion 38*a* thereof engaging the latching member housing 21 with the force of the latching member biasing structure 38, and a latching member engaging portion 38*b* thereof engaging the latching member 20 with the force of the latching member biasing structure 38. Yet other forms of the latching member biasing structure 38 may be used, provided that the latching member biasing structure 38 applies a latching member biasing structure force that urges the latching member 20 toward the latched position (shown, e.g., in FIGS. 4A and 4B), and provided that the force of the deformable member 26 during deformation thereof by application of the electric current thereto is greater than the force of the latching member biasing structure 38 so as to move the latching member 20 to the unlatched position (shown, e.g., in FIGS. 5A and 5B).

Figure 7:
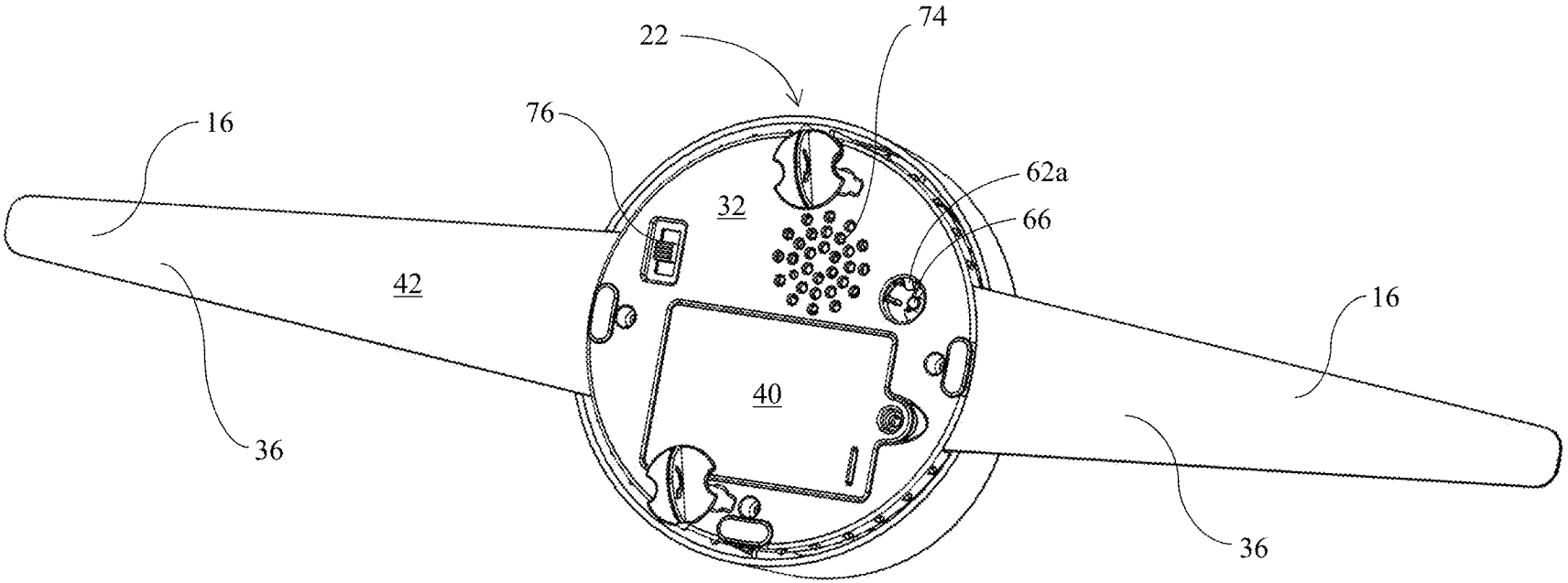
FIG. 7 depicts a bottom perspective view of an example driver assembly attached to flap biasing members.

With reference to FIGS. 2 and 7, as described above, the toy assembly 10 may further comprise the driver assembly 22 that may include a source of the electric current 40 (which, in the examples shown, comprises one or more batteries (the battery compartment being closed in FIG. 7 so as to obscure the source of the electric current 40)). The toy assembly 10 may further comprise an electrical conduit 42 for conducting the electric current from the driver assembly 22 and/or the source of the electric current 40 to the deformable member 26. The driver assembly 22 and/or the source of the electric current 40 may be remote from the deformable member 26 and supply the electric current to the deformable member 26 via the electrical conduit 42 upon a trigger event (as further described below). In the examples shown, the electrical conduit 42 may comprise at least a portion of the enclosure biasing structure 16, such as the flap biasing member 36, which connects to the deformable member 26 (such as to leads 27 thereof), in which case the flap biasing member(s) 36 may be formed from an electrically conductive material (e.g., an electrically conductive metal). In other aspects, the electrical conduit 42 may comprise, e.g., a wire running from the source of the electric current 40 and/or the driver assembly 22 to the deformable member 26, such as along one of the flap biasing members 36. Yet other forms of the electrical conduit 42, suitable for conducting the electric current from the source of the electric current 40 and/or the driver assembly 22 to the deformable member 26, may be used.

In some aspects, the source of the electric current 40 and/or the driver assembly 22 may be positioned in the base 32 (as shown, e.g., in FIG. 7), and the electrical conduit 42 may extend along one of the flaps 34 and/or flap biasing members 36 to the deformable member 26, as described above.

Figure 8:
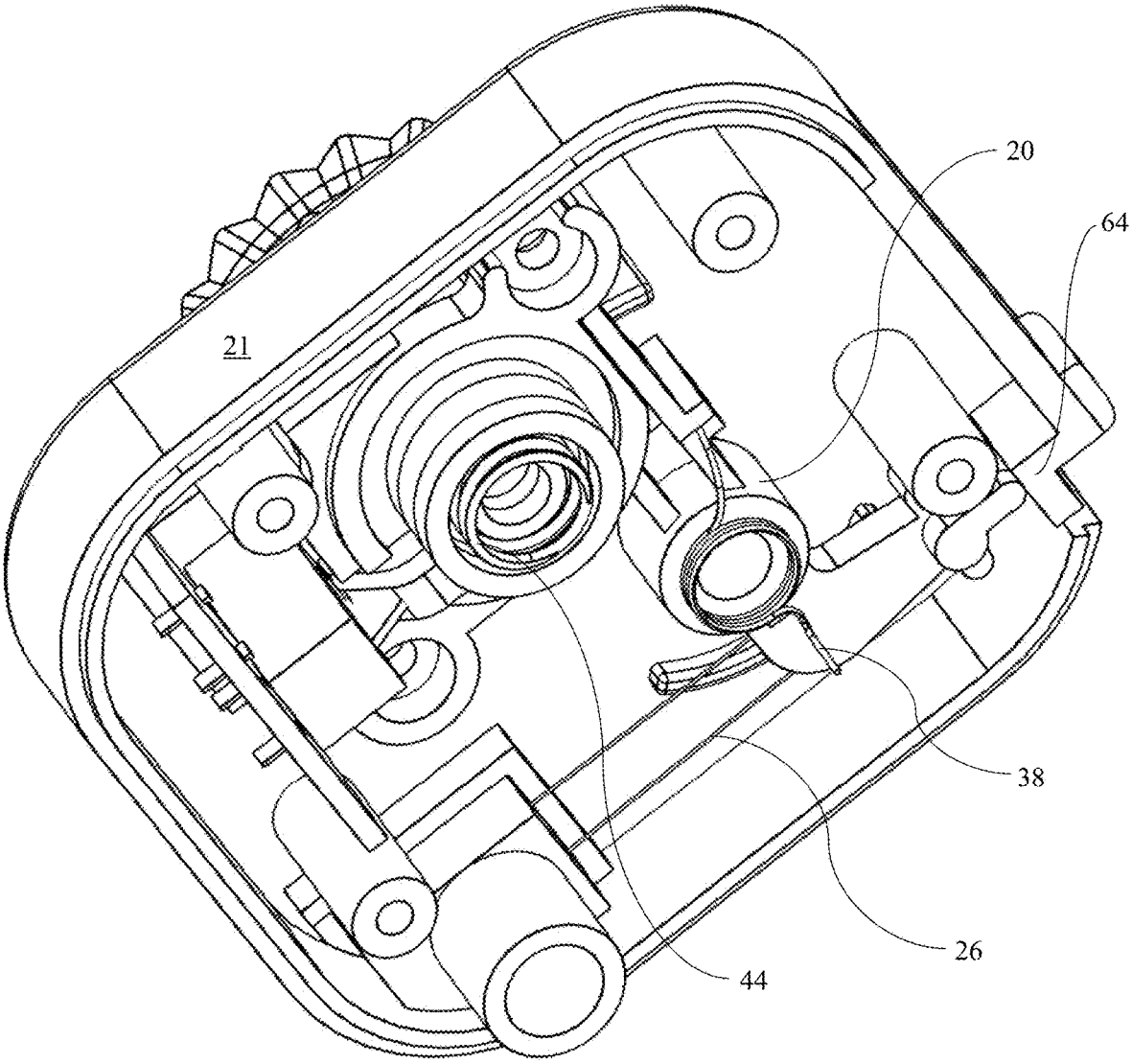
FIG. 8 depicts a partial perspective view of an upper portion of an example interior of an example latching member housing.
Figure 9:
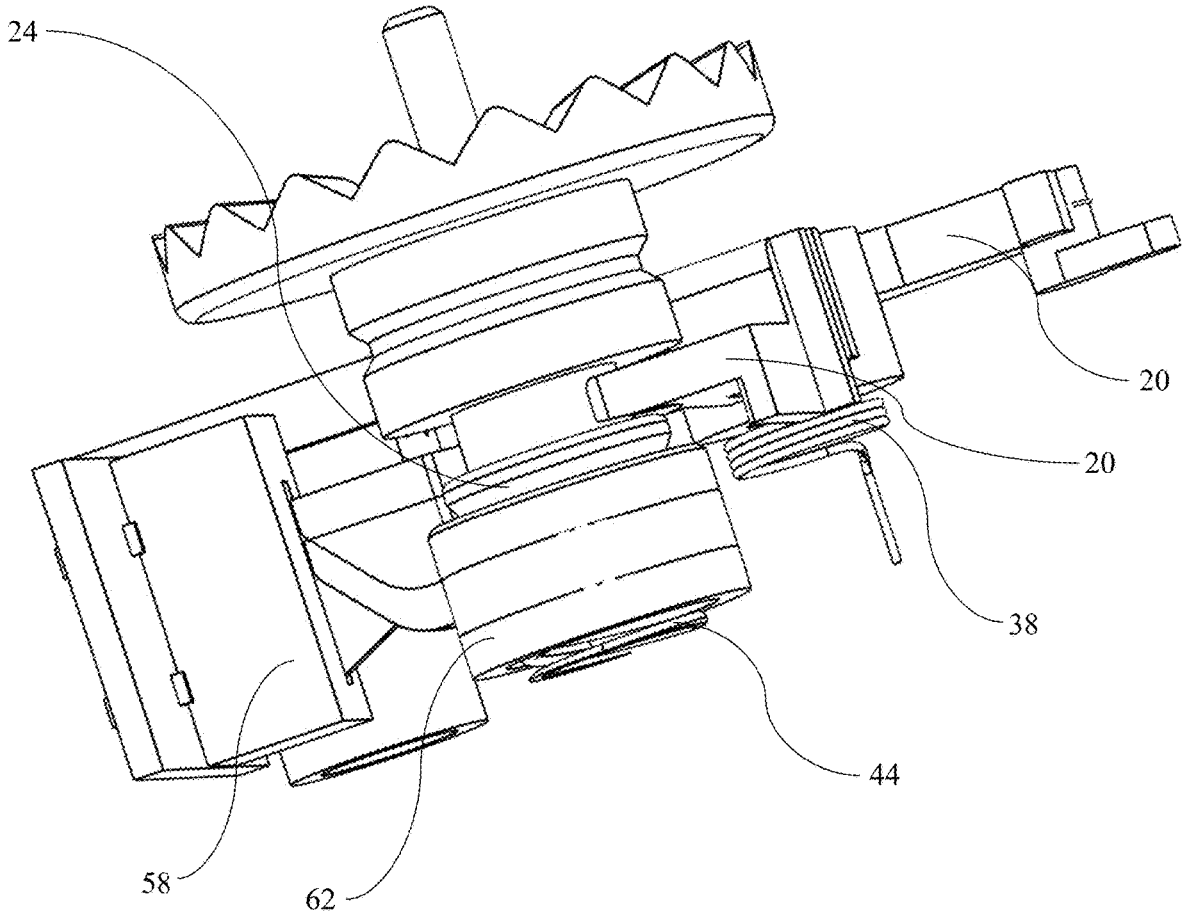
FIG. 9 depicts a perspective view of an example latching member releasably engaged with an example connecting member, and an example latching member biasing structure, connecting member biasing structure, interaction sensor, and latch sensor.

In some aspects, the connecting member 24 may be connected to a first one 35*a* of the plurality of flaps 34 and the latching member 20 may be connected to a second one 35*b* of the plurality of flaps 34, as shown, e.g., in FIG. 1B (in which the latching member 20 is housed within the latching member housing 21). With reference to FIGS. 8 and 9, in some aspects, the latch assembly 18 may further include a connecting member biasing structure 44 biasing the connecting member 24 away from the latching member 20 such that movement of the latching member 20 to the unlatched position (shown, e.g., in FIGS. 5A and 5B) permits the connecting member biasing structure 44 to drive the connecting member 24 away from the latching member 20, thereby driving, or at least partially driving, the first one 35*a* of the plurality of flaps 34 and the second one 35*b* of the plurality of flaps 34 away from one another (such as to expose the toy character 12 (i.e., when the toy assembly 10 or the flaps 34 are in the spread-open position shown in FIG. 1B)). In some aspects, the flap biasing member(s) 36 may be formed from a flexibly resilient material that is biased towards the spread-open position, which may further urge the connecting member 24 away from the latching member 20 to the spread-open position of the flaps 34 or the toy assembly 10. It will be appreciated that either or both of the connecting member biasing structure 44 and the flap biasing member(s) 36 may urge or drive the connecting member 24 away from the latching member 20 to position the flaps 34 in the spread-open position of the flaps 34 or the toy assembly 10 when the latching member 20 is in the unlatched position.

In the examples shown in the figures, the connecting member biasing structure 44 includes a compression spring 44 seated within the latching member housing 21 and positioned to receive thereon, and to be compressed by, the connecting member 24 when the connecting member 24 is releasably engaged with the latching member 20 (i.e., when the latching member 20 is in the latched position shown, e.g., in FIGS. 4A and 4B). Yet other forms of the connecting member biasing structure 44 may be used, provided that any such connecting member biasing structure 44 drives the connecting member 24, at least partially, away from the latching member 20 when the latching member 20 is moved to the unlatched position (shown, e.g., in FIGS. 5A and 5B).

Figure 10A:
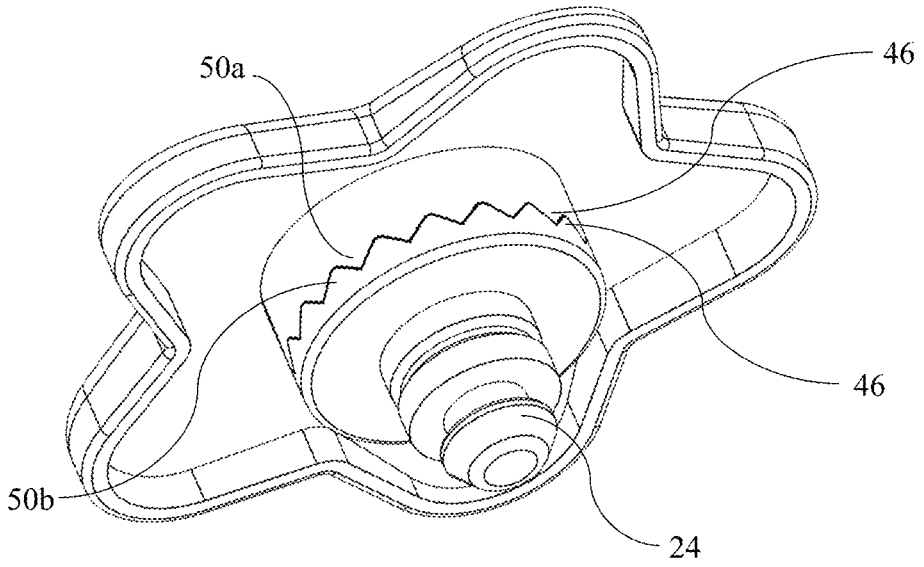
FIG. 10A depicts a perspective view of an example connecting member and connecting member flag engaging structure.
Figure 10B:
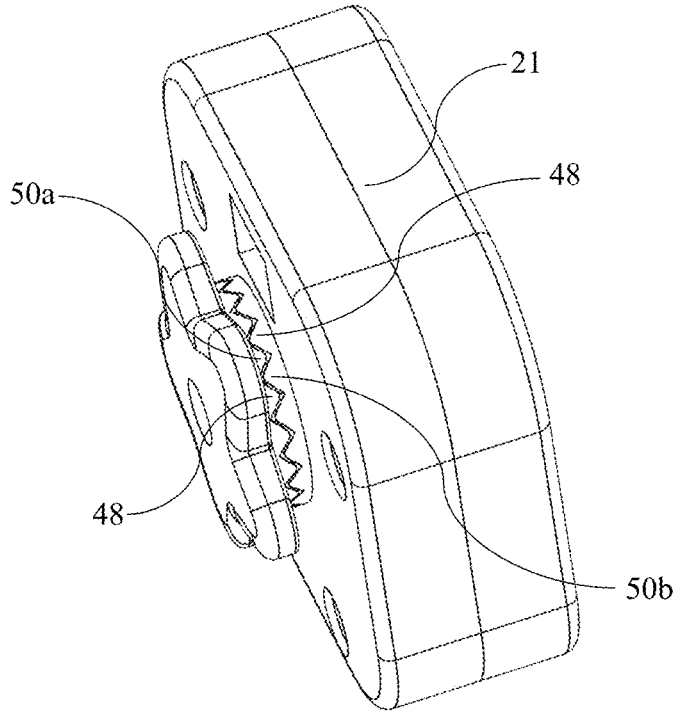
FIG. 10B depicts a perspective view of an example latching member housing and latching member flag engaging structure.

As described above, in some aspects, the connecting member 24 may be connected to a first one 35*a* of the plurality of flaps 34, and the latching member 20 may be connected to a second one 35*b* of the plurality of flaps 34, as shown in FIG. 1B (the latching member 20 in FIG. 1B being within the latching member housing 21). For example, as shown most clearly in FIG. 10, the connecting member 24 may include, or be attached to, a connecting member flag engaging structure 46, and the latching member 20 may include, or be attached to (such as by way of the latching member housing 21), a latching member flag engaging structure 48. For example, each of the flag engaging structures 46, 48 may include opposing tooth structures 50*a*, 50*b* that releasably, or fixedly, attach to one another with the respective flap 34 (such as a fabric material or toy blanket 34) therebetween such that the opposing and matingly engaged tooth structures 50*a*, 50*b* fix the flaps 34 in place therebetween. The flag engaging structures 46, 48, and/or any other part of the toy assembly 10 that is visible to a user in any of the configurations described herein, may include any shapes, colors, graphics and/or any other features, such as those that may be visually appealing to a user of the toy assembly 10. For example, and as shown in the figures, portions of the flag engaging structures 46, 48 (such as the outwardly facing portions thereof) may be star-shaped.

Figure 11:
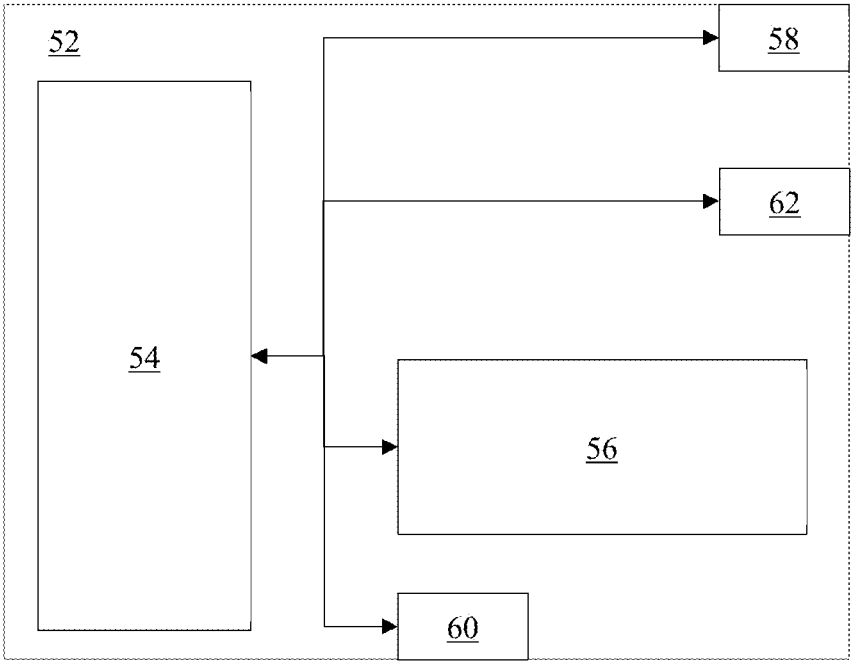
FIG. 11 depicts a schematic diagram of an example control system.
Figure 12:
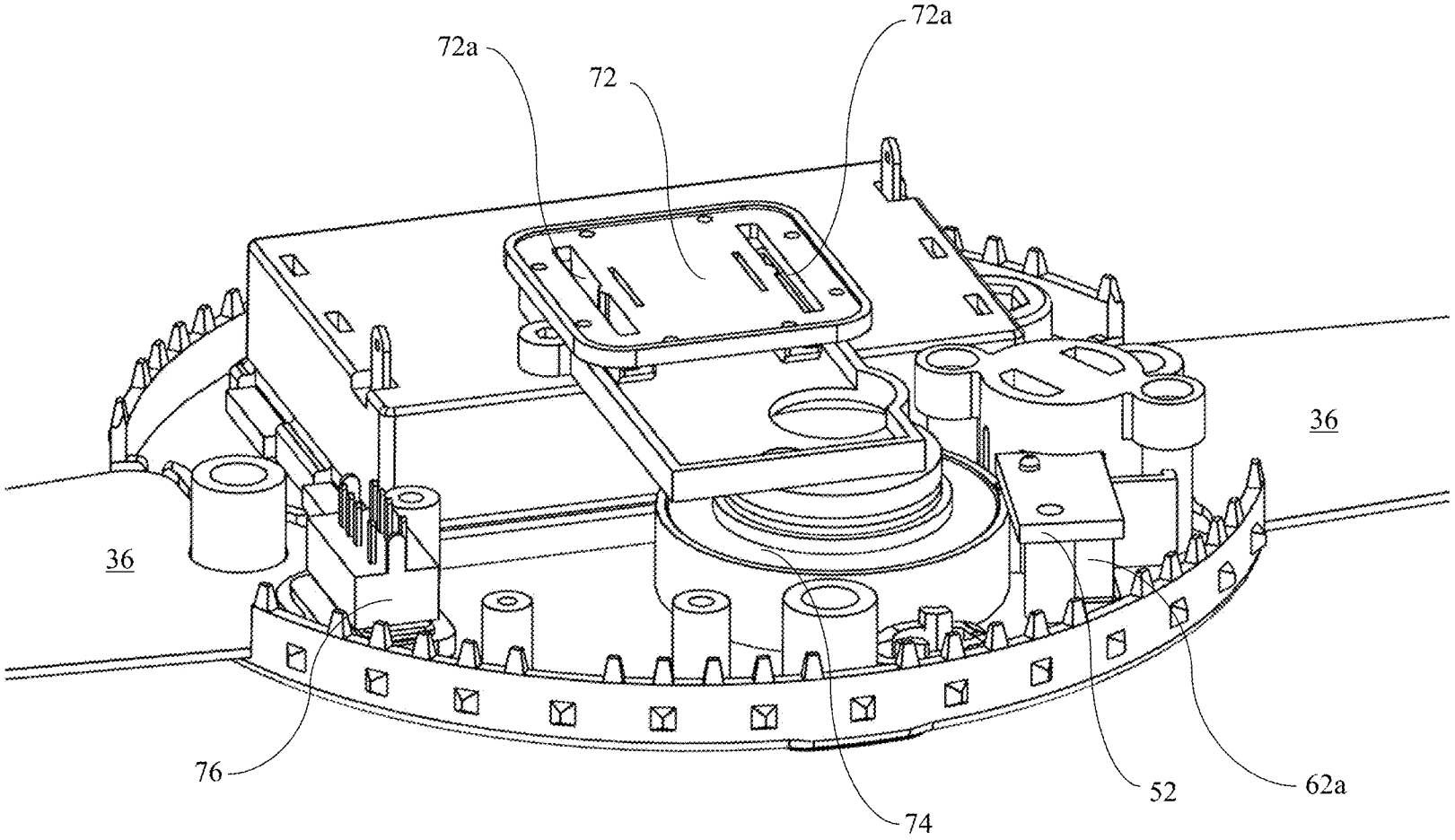
FIG. 12 depicts a partial perspective view of an example interior of an example driver assembly attached to example flap biasing members.

With reference to FIGS. 9, 11 and 12, in some aspects, the toy assembly 10 may further comprise a control system 52 that may include a processor 54, a memory 56 (which may include a non-transient computer-readable medium having stored therein or thereon instructions executable by the processor 54), and at least one interaction sensor 58 (which may include, e.g., an accelerometer 58) that is positioned to detect an interaction of a user with the toy assembly 10. Some or all components of the control system 52 may be collocated (e.g., on the same circuit board or within the same enclosure) or separate components. The control system 52 (which may comprise a computer or computing device 52) may further comprise a communication module or interface 60 for communication between components of the control system 52 (e.g., where one or more components of the control system 52 is a separate component (such as the separate example interaction sensor 58 shown in FIG. 9). The control system 52 may further comprise any other components known in the art for effecting its functions described herein, such as onboard communication bus(es).

The control system 52 may be programmed to permit the electric current to be conducted or transmitted the deformable member 26 in order to move the enclosure 14 to the open position (shown, e.g., in FIG. 1B) based on detection of the interaction of the user with the toy assembly 10 by the interaction sensor(s) 58. Where any components of the control system 52 are remotely located from one another (such as the example interaction sensor 58 shown in FIG. 9, which is housed within the latching member housing 21, apart from the processor 54 and the memory 56 of the control system 52 (shown by reference numeral 52 in FIG. 12)), the components of the control system 52 may be communicatively coupled to one another such as by wiring connecting the components of the control system 52 and running along one or more of the flap biasing member(s) 36, for example (although other forms of such communicative coupling suitable for communication between components of the control system 52 may be used, such as any suitable wired or wireless communication protocol and medium).

In some aspects, the control system 52 may further comprise at least one latch sensor 62 (see, e.g., FIGS. 9 and 11) that is positioned to detect which of the latched position (shown, e.g., in FIGS. 4A and 4B) and the unlatched position (shown, e.g., in FIGS. 5A and 5B) the latching member 20 is in. The latch sensor 62 may, e.g., include the processor 54 itself, which may detect when the electric current has been transmitted or conducted to the deformable member 26 so as to move the latching member 20 into, e.g., the unlatched position (shown, e.g., in FIGS. 5A and 5B), and/or the latching sensor(s) 62 may include a sensor 62 housed within the latching member housing 21 (as shown in FIG. 9) and which is communicatively coupled to the control system 52

(such as to the communication module 60 and/or the processor 54 thereof) by, e.g., a wired connection traversing the flap biasing member 36 to which the latching member housing 21 is attached. The processor 54 may be programmed to output at least one of audio output and visual output based on which of the latched position (shown, e.g., in FIGS. 4A and 4B) and the unlatched position (shown, e.g., in FIGS. 5A and 5B) the latching member 20 is in, as described in further detail below.

Figure 13:
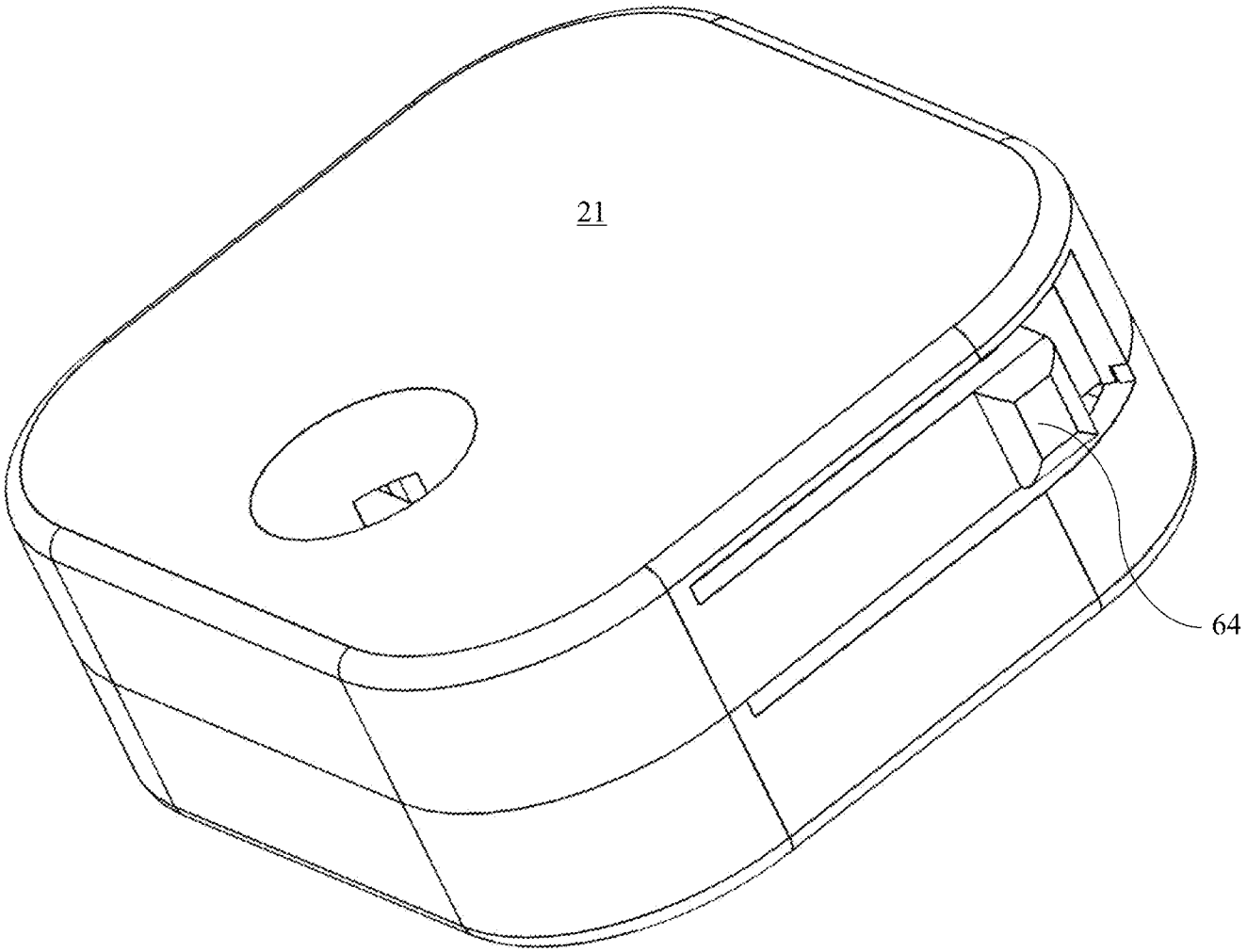
FIG. 13 depicts a perspective view of an example latching member housing showing an example manual unlatching member.

With reference to FIGS. 8 and 13, in some aspects, the toy assembly 10 may further comprise a manual unlatching member 64 that can be manually depressed into the latching member housing 21 by a user, from the exterior of the housing 21, so as to contact and apply a force against, and thereby move, the latching member 20 from the latched position (shown, e.g., in FIGS. 4A and 4B) to the unlatched position (shown, e.g., in FIGS. 5A and 5B). The manual unlatching member 64 may comprise, e.g., a spring-loaded button or, as shown in the figures, a flexibly resilient portion of the housing 21 that springs back to its undepressed position (shown in FIGS. 8 and 13) when it is no longer being depressed into the housing 21 by a user. Yet other suitable forms of the manual unlatching member 64 may be used, provided that they would permit a user to manually move the latching member 20 from the latched position (shown, e.g., in FIGS. 4A and 4B) to the unlatched position (shown, e.g., in FIGS. 5A and 5B), such as when the source of the electric current 40 is unavailable (e.g., where batteries 40 have been depleted).

Figures 14A, 14B, 14C, 14D, 14E:
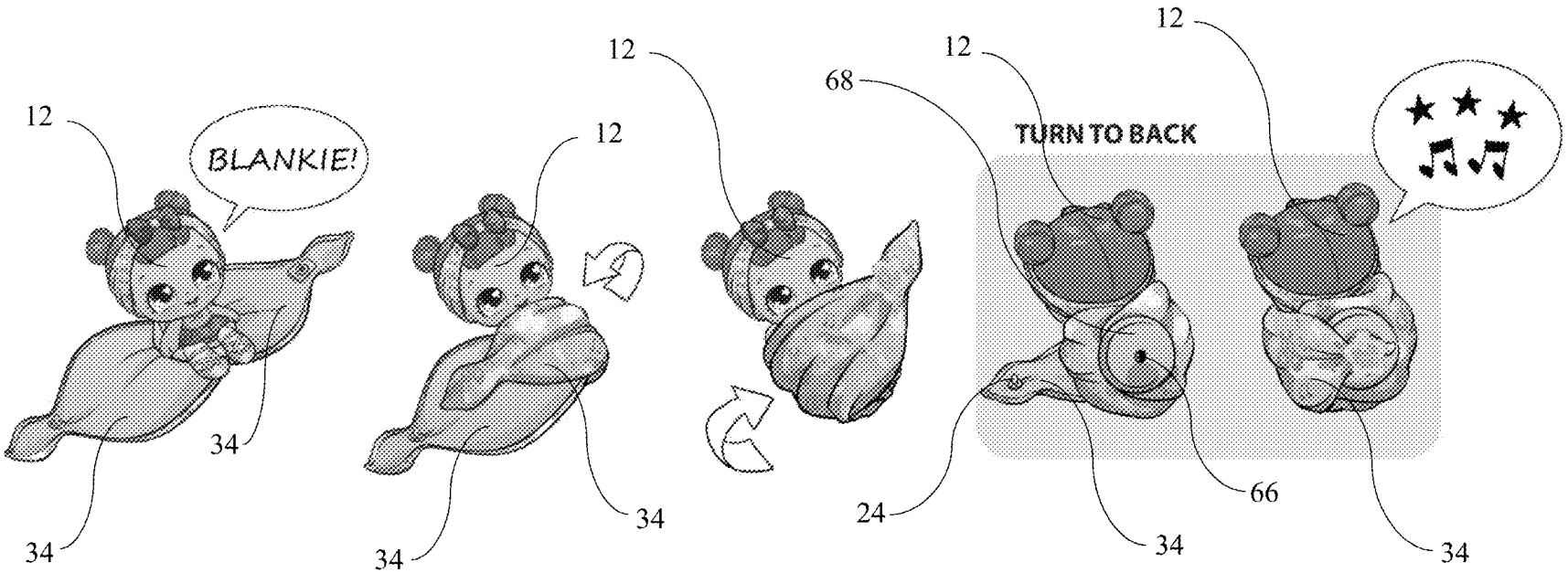
FIG. 14A depicts a front perspective view of an example toy assembly in an open configuration.
FIG. 14B depicts a front perspective view of the example toy assembly shown in FIG. 14A with a first flap folded over the toy character.
FIG. 14C depicts a front perspective view of the example toy assembly shown in FIG. 14B with a second flap, including an example connecting member, folded over the first flap.
FIG. 14D depicts a rear perspective view of the example toy assembly shown in FIG. 14C.
FIG. 14E depicts a rear perspective view of the example toy assembly shown in FIG. 14D, in a swaddle configuration in which the connecting member is releasably engaged to an example driver assembly latching member.

With reference to FIGS. 7 and 14, the driver assembly 22 may include a driver assembly latching member 66 for releasable engagement with the connecting member 24 (such as by friction fit or any other suitable manner of releasable engagement therebetween), such that the driver assembly latching member 66 may be in a driver assembly latched configuration (shown, e.g., in FIG. 14E) when the connecting member 24 is releasably engaged to the driver assembly latching member 66, and a driver assembly unlatched configuration (shown, e.g., in FIGS. 14A-D) when the connecting member 24 is disengaged from the driver assembly latching member 66.

Figure 15:
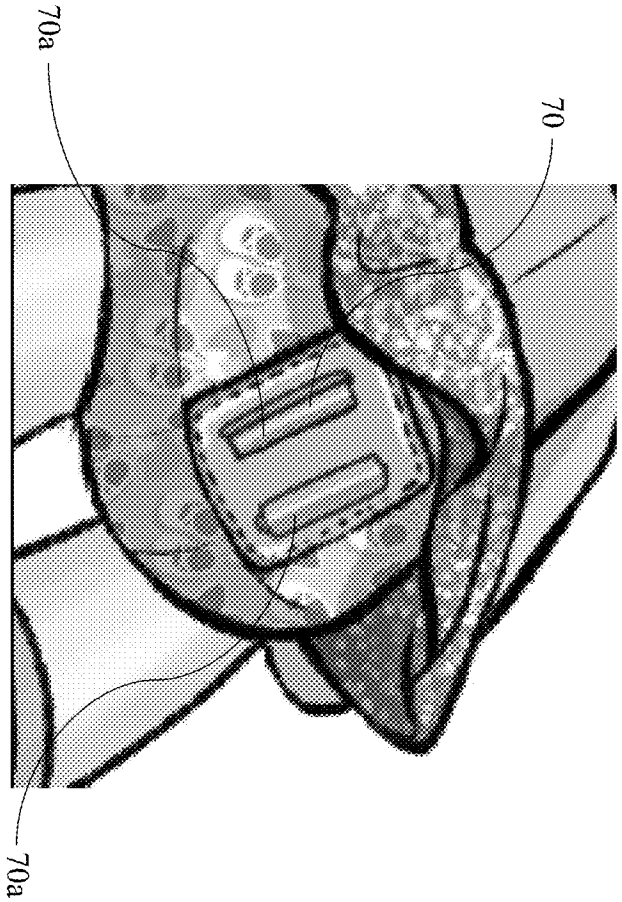
FIG. 15 depicts a partial rear view of an example toy character.

In some aspects, the driver assembly latching member 66 may be located on an opposite side 68 of the driver assembly 22 from the toy character 12 when the toy character 12 is releasably attached to the driver assembly 22, as most clearly shown in FIG. 14D. The toy character 12 may be releasably attached to the driver assembly 22 by, e.g., releasable attachment of a toy character connecting structure 70 to a toy character receiving structure 72 (see, e.g., FIGS. 2, 12 and 15). In the examples shown in the figures (see, e.g., FIGS. 2, 12 and 15), the toy character receiving structure 72 comprises receptacles 72*a* for releasable receipt or attachment therein of corresponding protrusions 70*a* on a rear side of the toy character 12, although it will be appreciated that any suitable structure(s) for achieving releasable attachment of the toy character 12 to the driver assembly 22 may be used. As shown in FIGS. 2 and 12, the toy character receiving structure 72 component of the driver assembly 22 may protrude above the base 32 that is positioned substantially about the driver assembly 22, so as to be positioned for releasable receipt of the toy character connecting structure 70 therein. In some aspects, the toy assembly 10 may further comprise a toy character attachment sensor (not shown) positioned to detect when the toy character 12 is attached to the driver assembly 22, and to communicate to the control system 52 (such as to the processor 54, such as by the communication module 60) the detected attachment of the toy character 12 to the driver assembly 22.

In some aspects, the at least one latch sensor 62 may include a driver assembly latching member sensor 62*a* (shown, e.g., in FIGS. 7 and 12) that is positioned to detect which of the driver assembly latched configuration and the driver assembly unlatched configuration the driver assembly latching member 66 or toy assembly 10 is in. With reference to FIGS. 14A to 14E, a user of the toy assembly 10 may, for example, not attach the flaps 34 to one another so as to place the flaps 34 in the mutually engaged position (shown, e.g., in FIG. 1A); rather, as shown in the progression of the toy assembly 10 from FIGS. 14A to 14E, one of the flaps 34 may be positioned within another of the flaps 34 (to which the connecting member 24 is attached), such that only the flap 34 having the connecting member 24 attached thereto is wrapped around the toy character 12 and releasably secured to the driver assembly latching member 66 via the connecting member 24. In the example toy assembly 10 shown in the figures, in which the flaps 34 include a toy blanket or blankets 34, this would allow a user to swaddle the toy character 12 (such as a baby doll 12) with the blanket(s) 34, as shown in FIG. 14E (in which the flaps 34 and the toy assembly 10 are in a swaddle position).

In accordance with some aspects, the trigger event (which may be pre-configured into the memory 56) may comprise a movement or set of movements detected by the at least one interaction sensor 58. The movement or set of movements may include, e.g., the movement(s) resulting from a user patting, rocking, bouncing, or holding upside down the toy assembly 10, and any combination and/or sequence thereof, and once detected by the interaction sensor(s) 58, the detected movement or set of movements may be communicated to the processor 54 (such as via the communication module 60). The processor 54, having detected (or received an indication of) the trigger event (i.e., the movement or the set of movements), may then cause the electric current to be supplied from the electric current source 40 to the deformable member 26 via the electrical conduit 42 to thereby move the latching member 20 to the unlatched position. In some aspects, the processor 54 may be programmed to output at least one of audio output and visual output based on which of the latched position and the unlatched position the latching member 20 is in.

In some aspects, the toy assembly 10 may further comprise one or more speakers 74 (see, e.g., FIGS. 7 and 12). In accordance with some aspects, the toy assembly 10 may output audio (such as by playing an audio output through the one or more speakers 74) based on one or more of: (i) whether the at least one latch sensor 62 detects that the latching member 20 is in the latched position or the unlatched position, or that the driver assembly latching member 66 is in the driver assembly latched configuration or the driver assembly unlatched configuration; and (ii) whether the at least one interaction sensor 58 detects the trigger event (e.g., the movement or the set of movements).

As shown in FIGS. 7 and 12, the toy assembly 10 may further comprise a power switch 76, which may allow a user to switch the toy assembly 10 between "on" and "off" states, and in some aspects, a "demo" state in which limited functions of the toy assembly 10 are available to a user.

In accordance with some aspects, a user playing with the toy assembly 10 would be able to interact with the toy assembly 10, such as by bouncing or patting the toy assembly 10 when the plurality of flaps 34 are in the mutually engaged position, so as to try to cause the flaps 34 to transition to the spread-open position. The processor 54 may detect, such as by latch sensor(s) 62, that the toy assembly 10 is bundled up (i.e., the flaps 34 are in the mutually engaged position), and the processor 54 may be configured to detect any movement or set of movements (such as those described above) which corresponds to a trigger event pre-configured into the memory 56. Upon detection of the trigger event (such as by communication of the movement or the set of movements from the interaction sensor(s) 58 to the processor 54, such as via the communication module 60), the processor 54 may cause the electric current to be supplied from the electric current source 40 to the deformable member 26 via the electrical conduit 42 to thereby move the latching member 20 to the unlatched position and thus cause the flaps 34 to spread apart (such as by the force of the connecting member biasing structure 44 and/or the flap biasing members 36) to their spread-open position, to thereby expose the toy character 12 to the user. In some aspects, the processor 54 may cause the speaker(s) 74 to play audio, such as a song, prior to the toy assembly 10 transitioning to the open position of the enclosure 14 (or the spread-open position of the flaps 34), to signal to the user that the toy assembly 10 is about to open and expose the toy character 12 within. The audio output (e.g., song) that is played may be specific to each type of toy character 12 which may include, e.g., dolls 12 of various appearances. The processor 54 may additionally or alternatively, cause the speaker(s) 74 to play, e.g., baby sounds (where the toy character 12 is a baby doll 12) based on the movement or set of movements detected by the interaction sensor(s) 58 and communicated to the processor 54.

In accordance with some aspects, when the processor 54 detects that the enclosure 14 is in the open configuration, such that the toy character 12 (such as a baby doll 12) is exposed, the processor 54 may be configured so as to cause the toy assembly 10 to output audio specific to the open configuration of the enclosure 54. For example, when a baby doll 12 is exposed, the processor 54 may be configured to cause the speaker(s) 74 to play, e.g., audio output indicative of an active baby or toddler (such as "Let's play!", "Blankie!", "He he swing!", "Rock rock!", Peeka boo!", and the like). In this mode of operation, the toy character 12 may, e.g., ask for her blanket(s) (or flaps) 34 to be swaddled, as shown in FIG. 14E, or may ask to play Peekaboo, in which case the processor 54 would detect, via the latch sensor(s) 62, when the flaps 34 are in the mutually engaged position, and play, e.g., the audio output "Peeka", open the flaps 34 (by causing the electric current to be supplied from the electric current source 40 to the deformable member 26 via the electrical conduit 42 to thereby move the latching member 20 to the unlatched position and thus cause the flaps 34 to spread apart to their spread-open position), and then cause the speaker(s) 74 to play the audio output "boo!" when the toy character 12 is exposed to the user.

In accordance with some aspects, a user playing with the toy assembly 10 would be able to interact with the toy assembly 10, such as by bouncing or patting the toy assembly 10 when the plurality of flaps 34 are in the swaddle position (shown in FIG. 14E). The processor 54 may detect, such as by the driver assembly latching member sensor 62*a*, that the toy assembly 10 is swaddled (i.e., the flaps 34 are in the swaddle position shown in FIG. 14E), and the processor 54 may be configured to detect any movement or set of movements (such as those described above). Upon detection of the movement or set of movements (such as by communication of the movement or the set of movements from the interaction sensor(s) 58 to the processor 54), the processor 54 may cause the speaker(s) 74 to output audio, and the audio that is outputted may be specific to the type of movement of set of movements detected, and/or the specific toy character 12 attached to the driver assembly 12. For example, when the flaps 34 are in the swaddle position, the processor 54 may cause the speaker(s) 74 to output cute laughing sounds when the user bounces the toy assembly 10 (which may progress to sounds of greater excitement the more the user bounces the toy assembly 10), a burp sound when the user pats the toy assembly 10 on the back, hiccup sounds when the user bounces the toy assembly 10 many times, joyous baby sounds when the user pats the toy assembly 10 on its front when laid horizontal, cooing/singing sounds when the user rocks the toy assembly 10 (and if the user stops the rocking motion before the toy character 12 transitions to a sleep mode, the processor 54 may cause the speaker(s) 74 to output crying sounds or sounds of disappointment), or a "bottle!" sound if the toy assembly 10 is laid down (i.e., horizontal) while swaddled.

The above description of sounds based on the detected state or configuration of the toy assembly 10 (e.g., bundled or enclosed (as shown, e.g., in FIG. 1A), open (as shown, e.g., in FIG. 1B), or swaddled (as shown, e.g., in FIG. 14E)) and detected movement(s) are just examples of possible interactions with a user that can take place (with various sound outputs and/or the opening of the flaps 34 taking place based on a detected movement or set of movements and/or the state of the toy assembly 10 (e.g., bundled or enclosed (as shown, e.g., in FIG. 1A), open (as shown, e.g., in FIG. 1B), or swaddled (as shown, e.g., in FIG. 14E)), and it will be appreciated that any combination of sounds or other user feedback (including visual feedback, such as by lights (not shown)) may be possible based detection by the sensors 58, 62, 62*a* (and/or the toy character attachment sensor (not shown)) and communication to the processor 54 of the above states and/or movement(s).

By driving the latching member 20 to the unlatched position remotely, via the remote driver assembly 22, the toy assembly 10 may avoid at least some of the bulk of the components required to drive the latching member 20 to the unlatched position (such as the source of the electric current 40 (e.g., batteries 40)) in undesirable areas of the toy assembly 10. For example, the source of the electric current 40 (e.g., the batteries 40) may be more suitably positioned within the driver assembly 22 and base 32 than in the latching member housing 21, which may allow the latching member housing 21 and its internal components, to which the flap 35*b* is attached (see, e.g., FIG. 1B), to be possibly smaller and lighter than would otherwise be possible, which in turn may allow for a more visually appealing toy assembly 10.

Any of the aspects described herein may be combined in any suitable manner. Persons skilled in the art will appreciate that there are yet more alternative implementations and modifications possible, and that the above examples are only illustrations of one or more implementations. The scope, therefore, is only to be limited by the claims appended hereto and any amendments made thereto.

What is claimed is:

1. A toy assembly, comprising:

a toy character;

an enclosure, wherein the enclosure includes an enclosure biasing structure, wherein the enclosure is positionable in a closed position to at least partially enclose the toy character, and wherein the enclosure biasing structure is positioned to urge the enclosure towards an open position to expose the toy character; and a latch assembly, including a latching member, and a deformable member that deforms upon application of an electric current; a control system that includes a processor, a memory, and at least one interaction sensor that is positioned to detect an interaction of a user with the toy assembly, wherein the latching member is movable between (i) a latched position in which the latching member is releasably engaged with a connecting member to hold the enclosure in the closed position, and (ii) an unlatched position in which the latching member is disengaged from the connecting member to permit the enclosure biasing structure to drive the enclosure towards the open position, wherein the deformable member is operatively engaged with the latching member such that deformation of the deformable member upon the application of the electric current thereto causes the latching member to move from the latched position to the unlatched position upon a trigger event, the trigger event being detection of a specific user interaction of a user with the toy assembly by the at least one interaction sensor.

2. The toy assembly as claimed in claim 1, wherein the enclosure includes a base and a plurality of flaps, each of the plurality of flaps having a proximal end connected to the base and a distal end, wherein the plurality of flaps are positionable in a spread-open position in which the plurality of flaps are spread apart from one another, which corresponds to the open position for the enclosure, and a mutually engaged position in which the distal ends of the plurality of flaps are mutually engaged with one another, which corresponds to the closed position for the enclosure, wherein the enclosure biasing structure includes a plurality of flap biasing members, wherein each of the plurality flap biasing members is operatively engaged with one of the plurality of flaps, to urge said one of the plurality of flaps to the spread-open position, and wherein the latching member in the latched position cooperates with the connecting member to hold the plurality of flaps in the mutually engaged position.

3. The toy assembly as claimed in claim 2, further comprising:

a driver assembly that includes a source of the electric current, and an electrical conduit for conducting the electric current from the driver assembly to the deformable member, wherein the source of the electric current is positioned in the base, and the electrical conduit extends along one of the flaps to the deformable member.

4. The toy assembly as claimed in claim 2, wherein the deformable member is looped around the latching member.

5. The toy assembly as claimed in claim 2, wherein the connecting member is connected to a first one of the plurality of flaps and the latching member is connected to a second one of the plurality of flaps, and wherein the latch assembly further includes a connecting member biasing structure biasing the connecting member away from the latching member such that movement of the latching member to the unlatched position permits the connecting member biasing structure to drive the connecting member away from the latching member, thereby driving said first one of the plurality of flaps and said second one of the plurality of flaps away from one another.

6. The toy assembly as claimed in claim 2, wherein the deformable member includes a wire made from a shape memory alloy.

7. The toy assembly as claimed in claim 6, wherein the deformable member contracts upon the application of the electric current thereto.

8. The toy assembly as claimed in claim 1, wherein the latch assembly includes a latching member biasing structure that applies a latching member biasing structure force to urge the latching member toward the latched position, a force of the deformable member during deformation by application of the electric current thereto being greater than the latching member biasing structure force so as to effect the transition of the latching member to the unlatched position by application of the electric current to the deformable member.

9. The toy assembly as claimed in claim 1, wherein the control system further includes at least one latch sensor that is positioned to detect which of the latched position and the unlatched position the latching member is in.

10. The toy assembly as claimed in claim 9, further comprising: a driver assembly that includes a source of the electric current, and an electrical conduit for conducting the electric current from the source of the electrical current to the deformable member, wherein the driver assembly includes a driver assembly latching member for releasable engagement with the connecting member, the driver assembly latching member in a driver assembly latched configuration when the connecting member is releasably engaged to the driver assembly latching member, and a driver assembly unlatched configuration when the connecting member is disengaged from the driver assembly latching member.

11. The toy assembly as claimed in claim 10, wherein the driver assembly latching member is located on an opposite side of the driver assembly from the toy character when the toy character is releasably attached to the driver assembly.

12. The toy assembly as claimed in claim 10, wherein the at least one latch sensor includes a driver assembly latching member sensor that is positioned to detect which of the driver assembly latched configuration and the driver assembly unlatched configuration the driver assembly latching member is in.

13. The toy assembly as claimed in claim 12, wherein the at least one interaction sensor includes an accelerometer.

14. The toy assembly as claimed in claim 12, wherein the trigger event comprises a movement or set of movements detected by the at least one interaction sensor and communicated to the processor, the processor causing the electric current to be supplied to the deformable member via the electrical conduit to thereby move the latching member to the unlatched position when the processor detects the movement or the set of movements.

15. The toy assembly as claimed in claim 14, wherein the control system comprises a non-transient computer-readable medium having stored therein or thereon instructions executable by the processor, wherein the trigger event is pre-configured into the memory.

16. The toy assembly as claimed in claim 14, wherein the toy assembly outputs audio based on one or more of:

whether the at least one latch sensor detects that the latching member is in the latched position or the unlatched position, or that the driver assembly latching member is in the driver assembly latched configuration or the driver assembly unlatched configuration; and whether the at least one interaction sensor detects the movement or the set of movements.

17. A toy assembly, comprising:

a toy character;

an enclosure, wherein the enclosure includes an enclosure biasing structure, wherein the enclosure is positionable in a closed position to at least partially enclose the toy character, and wherein the enclosure biasing structure is positioned to urge the enclosure towards an open position to expose the toy character;

a latch assembly; including a latching member; and a deformable member that deforms upon application of an electric current;

a driver assembly that includes a source of the electric current;

an electrical conduit for conducting the electric current from the source of the electric current to the deformable member; and a control system that includes a processor, a memory, and at least one interaction sensor that is positioned to detect an interaction of a user with the toy assembly wherein the latching member is movable between (i) a latched position in which the latching member is releasably engaged with a connecting member to hold the enclosure in the closed position, and (ii) an unlatched position in which the latching member is disengaged from the connecting member to permit the enclosure biasing structure to drive the enclosure towards the open position;

wherein the deformable member is operatively engaged with the latching member such that deformation of the deformable member upon the application of the electric current thereto causes the latching member to move from the latched position to the unlatched position; and wherein the driver assembly is remote from the deformable member and supplies the electric current to the deformable member via the electrical conduit upon a trigger event.

* * * * *